US005503377A

United States Patent [19]

Plickert et al.

[11] Patent Number: 5,503,377

[45] Date of Patent: Apr. 2, 1996

[54] DEVICE FOR MOUNTING ELEMENTS IN SHEET FORM

[76] Inventors: Bernd Plickert, Caspar-Theys-Str. 15, D-14193 Berlin; Theodor Parlevliet, Bamberger STr. 31, D-10779 Berlin, both of Germany

[21] Appl. No.: 107,852

[22] PCT Filed: Feb. 24, 1992

[86] PCT No.: PCT/DE92/00149

§ 371 Date: Aug. 26, 1993

§ 102(e) Date: Aug. 26, 1993

[87] PCT Pub. No.: WO92/14583

PCT Pub. Date: Sep. 3, 1992

[30] Foreign Application Priority Data

| | | | |
|---|---|---|---|
| Feb. 26, 1991 | [DE] | Germany | 41 06 424.0 |
| Nov. 27, 1991 | [DE] | Germany | 41 39 507.7 |

[51] Int. Cl.[6] ..... B25B 3/00

[52] U.S. Cl. ..... 269/21; 269/41

[58] Field of Search ..... 269/21, 41; 279/3; 294/64.1; 51/235; 248/363, 362

[56] References Cited

U.S. PATENT DOCUMENTS

| | | | |
|---|---|---|---|
| 799,922 | 9/1905 | Moxham | 269/21 |
| 3,174,188 | 3/1965 | Wood | 269/21 |
| 4,561,642 | 12/1985 | Parque | 269/21 |
| 5,135,206 | 8/1992 | Martinez | 269/21 |
| 5,245,736 | 9/1993 | Schertler | 269/21 |

FOREIGN PATENT DOCUMENTS

| | | | |
|---|---|---|---|
| 2513160 | 3/1983 | France . | |
| 1196336 | 7/1965 | Germany . | |
| 224009 | 6/1985 | Germany | 294/64.1 |
| 8701452 | 4/1987 | Germany . | |

*Primary Examiner*—Robert C. Watson
*Attorney, Agent, or Firm*—Mark P. Stone

[57] ABSTRACT

A device for mounting plate-like elements, such as glass plates, that form an object, for example shelves, when several are mounted together, and that are at first temporarily held by the mounting device and then fixed, for example, glued to each other, includes a suction line for generating a vacuum, the suction line being fastened to the elements, and components, for example, bars, that can be removably linked to each other and upon which the suction line can be removably fastened. The suction line can be coupled to flexible tubes which are coupled to a suction chamber and a suction pump. A manually-operated check valve is provided in the suction line connecting a suction region to the flexible tube. A small fixed gap, approximately 0.3 mm, is provided between the suction area and the surface of one of the plate-like elements, so that the suction holding force acts quickly when the check valve is opened. The suction regions defined by the suction line are coupled to the flexible tube by a small bore defining a diameter of approximately 1 mm such that any pressure increase in the suction region of the suction line does not affect the remaining portions of the suction system, or affects them only very slowly. The device of the present invention can be assembled in a quick, simple and precise manner.

14 Claims, 1 Drawing Sheet

DEVICE FOR MOUNTING ELEMENTS IN SHEET FORM

Figure 2:
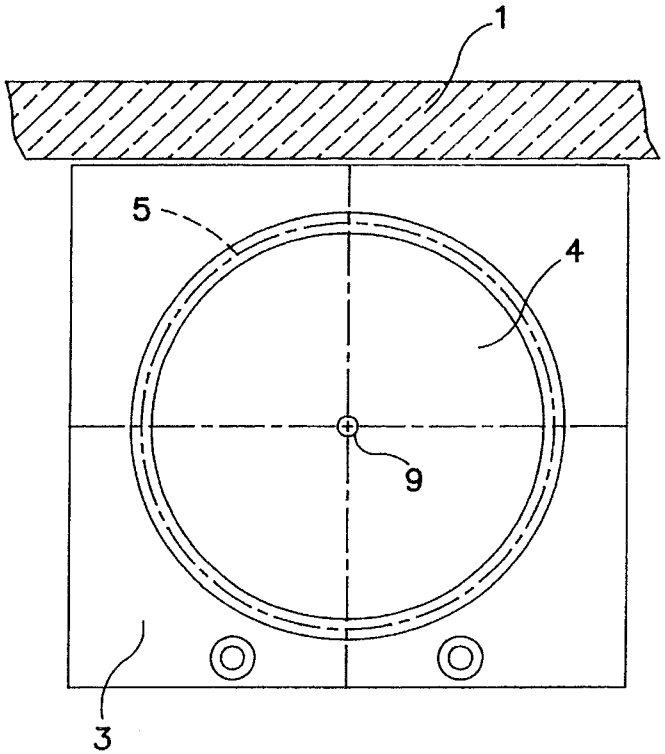

The invention relates to a device for mounting elements in sheet form, such as glass sheets, a plurality of which form an object, for example a shelf unit, and which are first temporarily held by the mounting device and then permanently joined together, for example by adhesive bonding, said device consisting of suction feet which are detachably fastenable to the elements by the creation of a vacuum, and of components, for example bars, which can be detachably joined together and to which the suction feet can be detachably fastened.

In a known device of this kind (DBGM 77 23 048) at each suction foot there is provided a tightening lever which can be turned over by hand and thus produces a vacuum under the suction foot. The distance between a surface of the element and the facing surface of the suction foot is variable and amounts to a few millimeters when the suction foot is in the holding position. The temporary mounting of an object by means of this device entails problems. Turning the tightening lever demands the application of a not inconsiderable force. This has a particularly detrimental effect in the case of objects, for example of glass, the mounting of which requires sensitive handling.

The problem underlying the invention is that of so constructing the device mentioned in the preamble that the temporary mounting is simpler and easier, that is particularly it is possible with less exertion of force.

According to the invention this problem is solved in that the suction feet can be connected by hoses to a vacuum tank connected to a vacuum pump, in that in each of the lines between the suction regions of the suction feet and the vacuum tank a shutoff valve which can be operated by hand and has an easy action is located, in that the suction regions of the suction feet are arranged with a very short fixed distance, particularly of about 0.3 mm, between the surface of the element and the facing surface of the suction foot, in such a manner that after the shutoff valve has been opened the holding force of the vacuum can act very quickly, and in that the suction regions of the suction feet are each connected via a very small bore, particularly one having a diameter of about 1 mm, to a hose in such a manner that any pressure increase in a suction region of a suction foot can affect the remainder of the vacuum system only very slowly or practically not at all.

With a device of this kind an object can be temporarily assembled simply and easily. This is primarily due to the fact that the turning of the tightening lever, which requires force in the known device, is eliminated.

The very short distance between the .elements and the facing surfaces of the suction foot, resulting in very rapid action of the vacuum after the shutoff valve has been opened, provides the advantage that the temporarily assembled object has great rigidity. The very small bore has the consequence that any leakage in a suction region of a suction foot will not give rise to the disconnection of the elements already assembled.

A further development of the invention consists in that the wall region of a suction foot facing the element is inelastic and that a sealing strip lying against the element is situated in the edge of the suction foot. The elements are thus seated substantially immovably on the suction feet, thus further increasing the rigidity of the temporarily assembled object.

In addition, it is proposed that the shutoff valve should be disposed on the suction foot. Handling is particularly simple as a result.

It is then proposed that the shutoff valve should have a reciprocatingly slidable sleeve which surrounds the line and by which the passage of air is blocked in one position and freed in the other position. This configuration of the shutoff valve results in a further simplification in respect of handling.

A further development of the invention then consists in that on its side remote from the suction region the suction foot has a pin which preferably projects at right angles and by means of which the suction foot can be connected to the components. This configuration permits simple fastening of the suction foot to the components, that is to say to the structure formed by the components, for example by fastening the suction foot by means of a clamp element to a component, for example a bar.

It is in addition proposed that a suction foot should have a first suction region preferably in the form of a single circular region for a flat surface of the element. This would be the simplest form of a suction foot.

It is then proposed that a second suction region of the same kind should be disposed preferably at right angles to the first suction region. This would be a further development of the suction foot previously defined, thus preferably permitting the joining of two elements, particularly when they are to be disposed at right angles to one another.

In addition it is proposed that the two suction regions should be formed by an angle section and be joined together preferably by a fixed bow spanning the angle of 90°. This bow facilitates the handling of the part which is provided with the two suction regions.

It is expedient for the two suction regions to be in the form of plates joined together by means of arms which are pivotally and fastenably joined together. In this way it is possible to adjust any desired angles between the suction regions.

Furthermore, it is proposed that a third suction region of the same kind should be disposed preferably at right angles to the other two. This configuration makes it possible to join together three plates, disposed in each case at an angle to one another.

It is then expedient that the vacuum tank and the pump form a portable unit. The handling of these two parts is thus particularly simple.

It is further proposed that an assembly table should be provided, the beams of which, in particular the horizontal beams, are provided with a first connection leading to the vacuum tank, and with second connections to which the hoses can be connected. This table permits easy and simple assembly of any object.

It is then proposed that pneumatic quick-acting closures should be provided at the ends of the hoses remote from the suction feet. This measure likewise facilitates the handling of the whole arrangement.

Finally, it is proposed that a sealing ring for a suction region should have a coefficient of friction slightly higher than or equal to 0.3 in relation to glass, plastic material and the like. It is thereby ensured that the slipping of the suction feet relative to the elements will be largely avoided.

Figure 1:
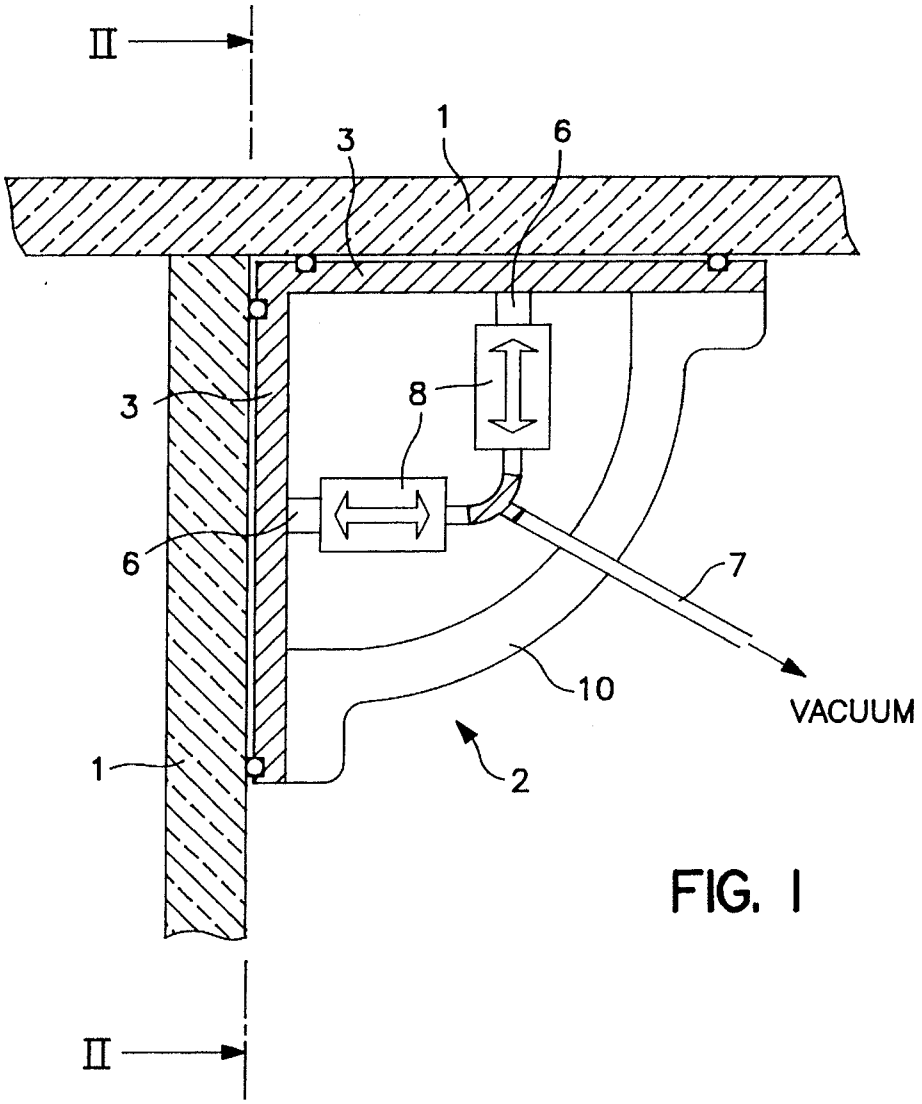

Further details of the invention can be seen from the drawings, in which:

FIG. 1 is a side view, partly in section, of one embodiment of the invention, and FIG. 2 is a section on the line II—II in FIG. 1.

In FIGS. 1 and 2 the reference 1 designates two glass sheets and 2 designates a mounting device according to the invention, which holds together the two glass sheets. The mounting device 2 consists of two plates 3, which are arranged at right angles to one another and which form suction regions. These suction regions have a circular shape 4 (see FIG. 2). They are surrounded by a sealing ring 5 lying in a groove. Said ring has a relatively high coefficient of friction in relation to glass and the like, so that transverse displacements are avoided. A suction region 4 is connected by means of a connection 6 to a hose 7 which leads to a vacuum tank. A shutoff valve 8 in the form of a reciprocatingly slidable sleeve is disposed in the connections 6: when the sleeve is in one of its positions, the passage of air is blocked; in the other position the passage is freed. 9 designates an opening forming the connection between the part 6 and the suction region 4. This opening is very small. An increased pressure in the suction region can consequently act only very slowly on the remainder of the system. The suction region 4 is very narrow, with the consequence that after the mounting device has been placed against the glass sheet, and after the connection has been opened so that the vacuum can act, the mounting device is very quickly seated firmly on the sheet. Furthermore, as a result no noteworthy spring action occurs and tilting and the like between the suction foot and the element in sheet form is avoided. The two plates 3 are connected together by a bow 10 which facilitates the handling of the mounting device.

It is naturally also possible to provide only a single component on which everything else is fastened.

We claim:

1. In a device of the type for mounting elements in sheet form, a plurality of said elements forming an object, said elements being initially temporarily held together by the device and thereafter permanently joined together, said device comprising suction feet formed from a plurality of components removably attached together and provided for holding said elements together by the creation of a vacuum, the improvement comprising the suction feet each being connected by a separate connecting line (6) to a hose (7), said hose being Coupled to a vacuum tank connected to a vacuum pump; wherein each of said connecting lines (6) is removably coupled at one end thereof to a suction region (4) defined on a different one of said plurality of said components of said suction feet; a manually operated shutoff valve (8) in each of said connecting lines between said suction region (4) of each of said plurality of components and said hose; wherein the suction region (4) of each component is spaced a distance which does not substantially exceed 0.3 mm from the surface of an element (1) facing said component for defining a vacuum region therebetween, and wherein the suction region (4) of each of said plurality of components is connected via a bore (9) defined in said connecting line (6) coupled to said component, said bore having a diameter not substantially exceeding 1 mm, said connecting line (6) being coupled by said bore defined therein to one end of said hose (7) and to said vacuum tank coupled to another end of said hose (7).

2. A mounting device as claimed in claim 1, wherein said component of said suction foot facing a corresponding one of said elements (1) is inelastic, and wherein a sealing strip lying against the element (1) is situated in the edge of the suction foot.

3. A mounting device as claimed in claim 1, wherein the shutoff valve (8) is disposed on the suction foot.

4. A mounting device as claimed in claim 1, wherein said suction region (4) defined on at least one of said suction feet includes a first suction region in the form of a single circular configuration for a flat surface of one of said elements (1).

5. A mounting device as claimed in claim 4, wherein a second suction region of the same kind as said first suction region which is disposed at a substantially right angle to the first suction region.

6. A mounting device as claimed in claim 5, wherein said first and second suction regions are formed by an angle section and are joined together by a fixed bow (10) spanning an angle of 90°.

7. A mounting device as claimed in claim 5, wherein said first and second suction regions are formed on plates, and said device includes means for pivotably connecting said plates together.

8. A mounting device as claimed in claim 1, wherein the vacuum tank and the pump form a portable unit.

9. A mounting device as claimed in claim 1, wherein a sealing ring (5) for a suction region has a coefficient of friction of about > 0.3 in relation to glass, plastic material and the like.

10. A mounting device as claimed in claim 2, wherein the shutoff valve (8) is disposed on the suction foot.

11. A mounting device as claimed in claim 1 wherein said spacing between said component of said suction foot and said element in sheet form is substantially 0.3 mm.

12. A mounting device as claimed in claim 1 wherein said diameter of said bore (9) is substantially 1 mm.

13. A mounting device as claimed in claim 1 wherein said elements in sheet form include glass sheets.

14. A mounting device as claimed in claim 1 wherein said object formed from said elements includes shelf means.

* * * * *